US011737638B2

(12) United States Patent
Durham et al.

(10) Patent No.: US 11,737,638 B2
(45) Date of Patent: Aug. 29, 2023

(54) DISHWASHER APPLIANCE WITH CAMERA FOR DETERMINATION OF DOOR POSITION

(71) Applicant: Haier US Appliance Solutions, Inc., Wilmington, DE (US)

(72) Inventors: Kyle Edward Durham, Louisville, KY (US); Tal Abraham Ohayon, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/202,739

(22) Filed: Mar. 16, 2021

(65) Prior Publication Data

US 2022/0296073 A1 Sep. 22, 2022

(51) Int. Cl.
*A47L 15/00* (2006.01)
*A47L 15/42* (2006.01)

(52) U.S. Cl.
CPC ..... *A47L 15/0049* (2013.01); *A47L 15/0063* (2013.01); *A47L 15/4257* (2013.01)

(58) Field of Classification Search
CPC ..... A47L 15/0049; A47L 15/0063; A47L 15/4257
See application file for complete search history.

(56) References Cited

U.S. PATENT DOCUMENTS

| | | | | |
|---|---|---|---|---|
| 9,860,491 | B2 * | 1/2018 | Park | H04N 7/183 |
| 10,624,522 | B1 * | 4/2020 | Chan | G08B 21/18 |
| 2018/0107879 | A1 * | 4/2018 | Laput | G06N 5/041 |
| 2019/0343367 | A1 * | 11/2019 | Jung | A47L 15/4295 |
| 2019/0382941 | A1 | 12/2019 | Hwang | |
| 2020/0193344 | A1 | 6/2020 | Sham | |
| 2020/0301382 | A1 | 9/2020 | Digman | |
| 2021/0093149 | A1 * | 4/2021 | Fawaz | A47L 15/4282 |

FOREIGN PATENT DOCUMENTS

| | | | | |
|---|---|---|---|---|
| CN | 108529367 | A * | 9/2018 | |
| DE | 102012209679 | A1 | 12/2013 | |
| DE | 102017223258 | A1 * | 1/2019 | A47L 15/0013 |
| DE | 102018009311 | A1 * | 5/2020 | |
| DE | 102020109302 | A1 * | 10/2020 | |
| DE | 102020112027 | A1 * | 11/2020 | |
| DE | 102020100152 | A1 * | 7/2021 | |
| DE | 102020117383 | A1 * | 1/2022 | |
| EP | 3427630 | A1 | 1/2019 | |
| EP | 3633271 | A1 * | 4/2020 | E05F 15/70 |
| EP | 3933679 | A1 * | 1/2022 | |
| WO | WO-2019015990 | A1 * | 1/2019 | |
| WO | WO2019110305 | A1 | 6/2019 | |

OTHER PUBLICATIONS

Lind (DE 102020112027 A1, Machine Translation generated Sep. 22, 2022 by Espacenet.com) (Year: 2022).*
Ding et al., CN-108529367-A,MachineTranslation . (Year: 2023).*

* cited by examiner

*Primary Examiner* — Duy Vu N Deo
*Assistant Examiner* — Christopher Remavege
(74) *Attorney, Agent, or Firm* — Dority & Manning, P.A.

(57) ABSTRACT

A dishwasher appliance having a camera assembly. The dishwasher appliance is configured for obtaining an image of the door, determining the position of the door relative to a tub of the appliance; and using the position of the door in one or more dishwashing operations.

18 Claims, 5 Drawing Sheets

DISHWASHER APPLIANCE WITH CAMERA FOR DETERMINATION OF DOOR POSITION

FIELD OF THE INVENTION

The present disclosure relates generally to dishwasher appliances, and more particularly to a dishwasher appliance using a camera for determination of the position or angle of a door.

BACKGROUND OF THE INVENTION

Dishwasher appliances generally include rack assemblies for positioning various articles for cleaning within a wash chamber. One or more devices such as nozzles or spray assemblies may be included at various locations relative to the rack assemblies for purposes of delivering fluids as part of the cleaning process. To maintain such fluid within the wash chamber during a cleaning cycle, the appliance is typically provided with a door that can be selectively opened or closed by the user.

During the normal use of the dishwashing appliance, the door is opened frequently. For example, the user may open the door, load articles for cleaning, and close the door before beginning a cleaning cycle. The door may also be opened and closed several times intermittently between cleaning cycles if the user desires to fully load the dishwasher appliance before launching a cleaning cycle. The door may also be opened and closed for purposes of adding detergent, additives, or other components desired for the cleaning cycle.

Dishwashing appliances may include a latch that engages the door in the closed position. The latch may allow the door to be locked into the closed position during a cleaning cycle. The dishwashing appliance may include e.g., detection features for determining if the latch is engaged so that operation of the appliance does not occur if the door is not in the closed position. Operating the dishwashing appliance with the door even partially open could lead to an undesirable release of fluid from the appliance.

Such detection features can typically only determine whether the door is in a closed position based on whether the e.g., the latch is engaged or the top of the door is in full contact with the cabinet. More particularly, such features typically cannot readily determine whether the door is in a wide or fully open position versus a nearly or partially closed position. Intermediate positions of the door between closed and fully open are also usually not determinable by such detection features.

Yet, knowing the location of the door at positions other than just when it is in a closed position can be useful information. For example, while a fully open position may be readily apparent to a user, a nearly closed position may be mistakenly perceived by the user as closed. As such, users may believe they have started the appliance by e.g., selecting a desired cycle and shutting the door fully when in fact the door is not fully closed and the appliance will not start. As stated already, typical detection features associated with the latch mechanism cannot determine this partially open position and provide a related notification thereof to the user.

Accordingly, a dishwashing appliance with features for detecting the position of the door would be useful. More particularly, a dishwashing appliance that can recognize the specific position of an open door would be beneficial. A dishwashing appliance that can also use such information in one or more operations of the appliance would also be useful.

BRIEF DESCRIPTION OF THE INVENTION

Aspects and advantages of the invention will be set forth in part in the following description, or may be apparent from the description, or may be learned through practice of the invention.

In one exemplary embodiment, the present invention provides a dishwasher appliance having a tub defining a wash chamber for receipt of articles for washing. The tub has a front opening. A door positioned is adjacent to the tub at the front opening and configured for selectively pivoting between closed and open positions. One or more rack assemblies can be positioned within the wash chamber. A camera assembly can be mounted within the wash chamber with a view of the door and the front opening to the wash tub. A controller may be operably coupled with the camera assembly and may be for obtaining an image of the door and wash tub, determining the position of the door relative to the tub; and using the position of the door in one or more dishwashing operations.

In another exemplary aspect, the present invention provides a method of operating a dishwashing appliance having a door and a tub defining a wash chamber. The method includes obtaining an image of the door and tub; determining the position of the door relative to the tub; and using the position of the door in one or more dishwashing operations.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
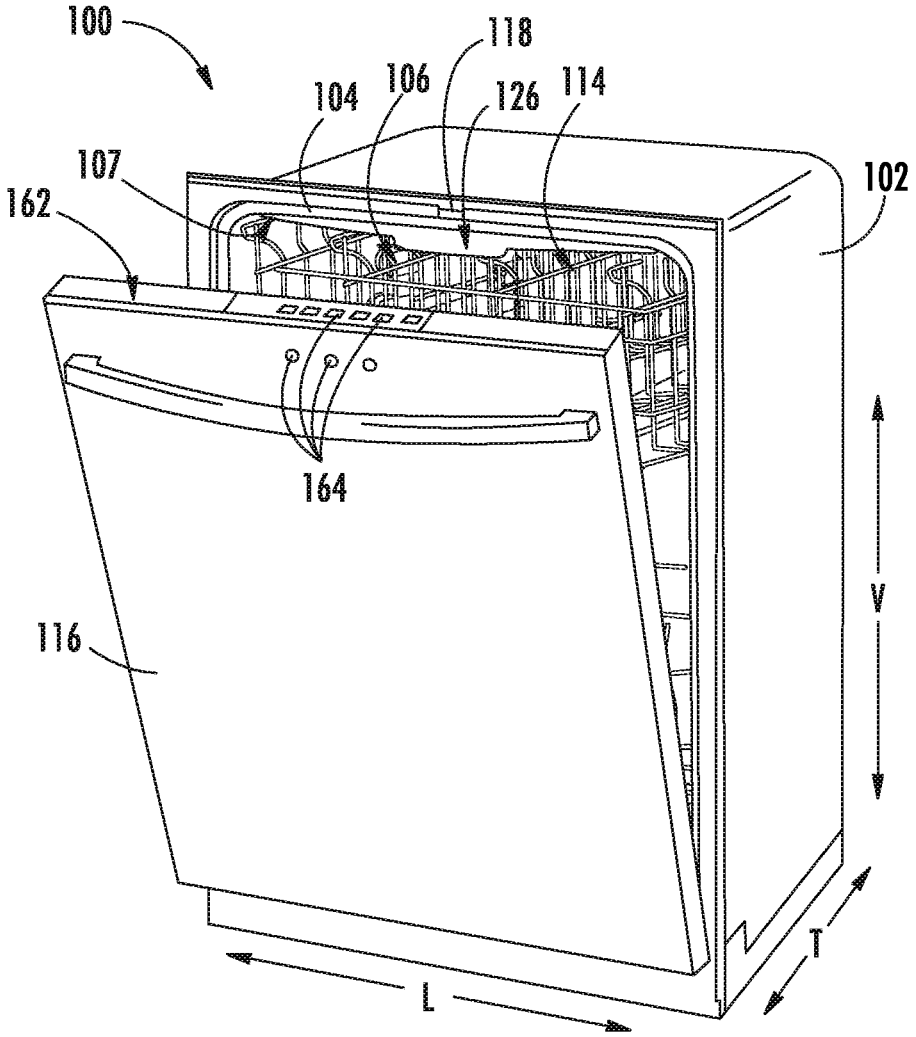
FIG. 1 provides a perspective view of an exemplary embodiment of a dishwashing appliance of the present disclosure with a door in a partially open position.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "includes" and "including" are intended to be inclusive in a manner similar to the term "comprising." Similarly, the term "or" is generally intended to be inclusive (i.e., "A or B" is intended to mean "A or B or both"). Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. For example, the approximating language may refer to being within a 10 percent margin.

As used herein, the term "article" may refer to, but need not be limited to dishes, pots, pans, silverware, and other cooking utensils and items that can be cleaned in a dishwashing appliance. The term "wash cycle" is intended to refer to one or more periods of time during which a dishwashing appliance operates while containing the articles to be washed and uses a detergent and water, preferably with agitation, to e.g., remove soil particles including food and other undesirable elements from the articles. The term "rinse cycle" is intended to refer to one or more periods of time during which the dishwashing appliance operates to remove residual soil, detergents, and other undesirable elements that were retained by the articles after completion of the wash cycle. The term "drain cycle" is intended to refer to one or more periods of time during which the dishwashing appliance operates to discharge soiled water from the dishwashing appliance. The term "cleaning cycle" is intended to refer to one or more periods of time that may include a wash cycle, rinse cycle, and/or a drain cycle. The term "wash fluid" refers to a liquid used for washing and/or rinsing the articles and is typically made up of water that may include other additives such as detergent or other treatments.

Figure 2:
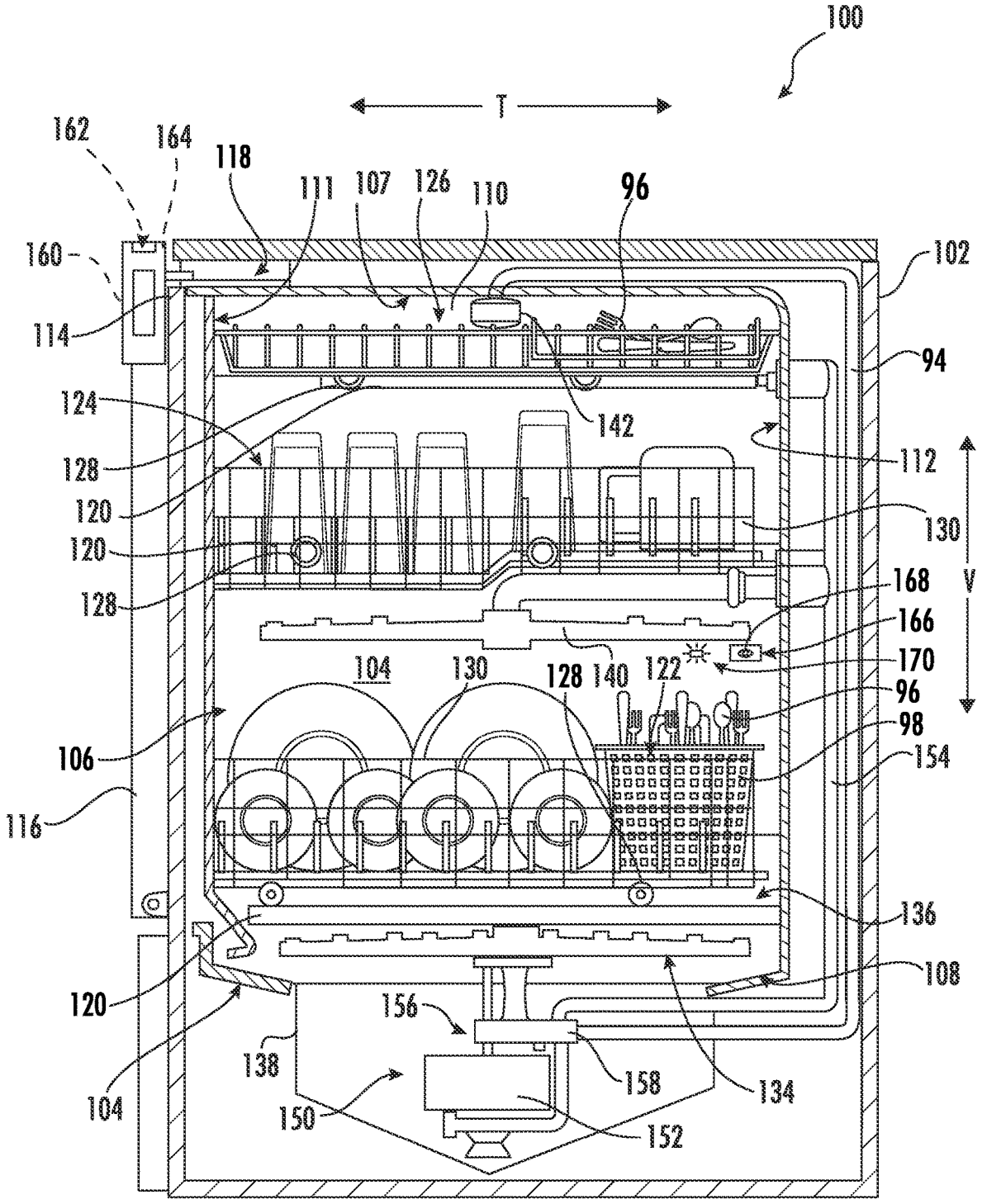
FIG. 2 provides a side, cross sectional view of the exemplary dishwashing appliance of FIG. 1 with the door in a closed position.

FIGS. 1 and 2 depict an exemplary domestic dishwasher or dishwashing appliance 100 that may be configured in accordance with aspects of the present disclosure. For the particular embodiment of FIGS. 1 and 2, the dishwasher 100 includes a cabinet 102 (FIG. 2) having a tub 104 therein that defines a wash chamber 106. As shown in FIG. 2, tub 104 extends between a top 107 and a bottom 108 along a vertical direction V, between a pair of side walls 110 along a lateral direction L, and between a front side 111 and a rear side 112 along a transverse direction T. Each of the vertical direction V, lateral direction L, and transverse direction T are mutually perpendicular to one another.

Figure 3:
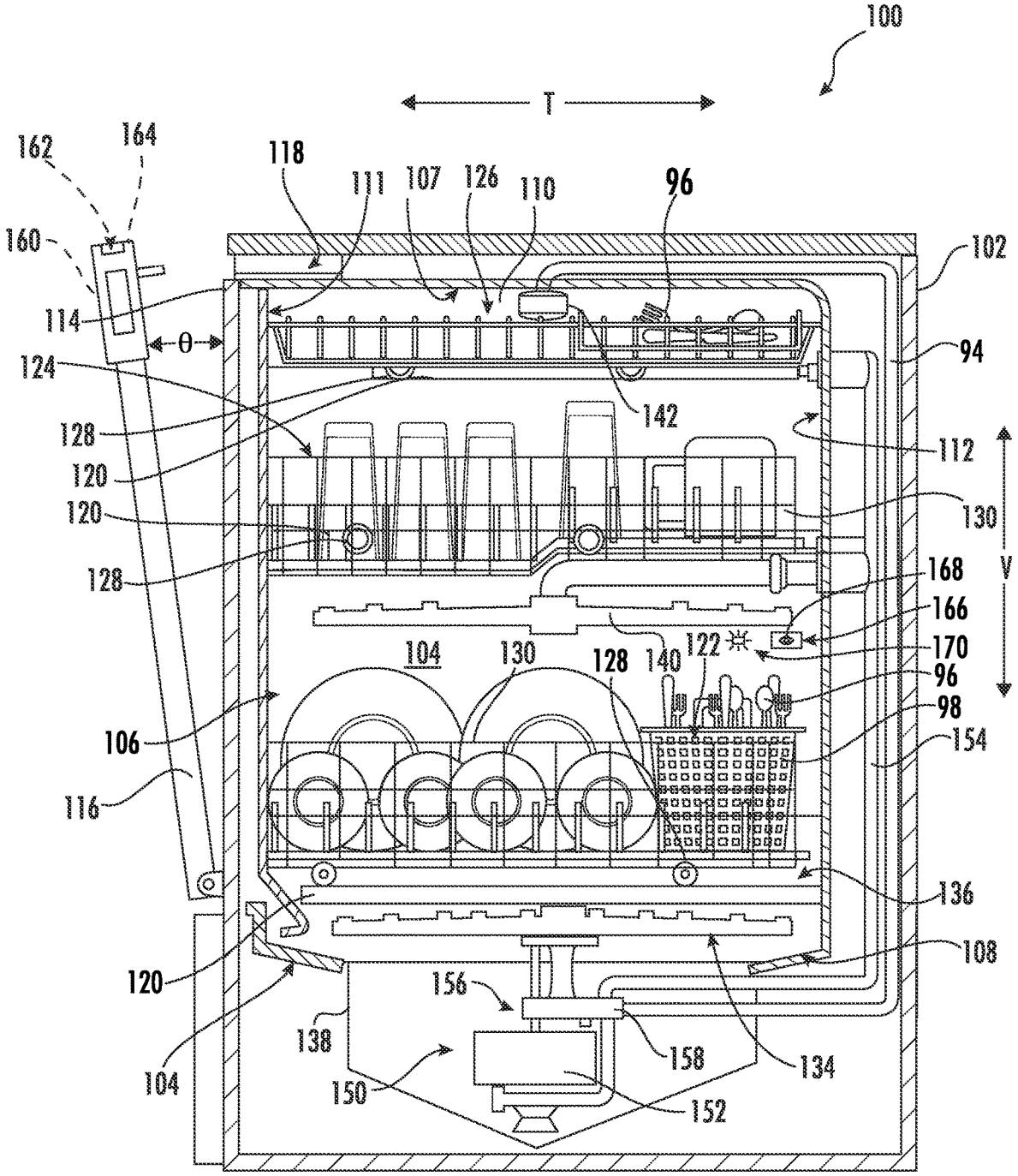
FIG. 3 provides another side, cross sectional view of the exemplary dishwashing appliance of FIG. 1 with the door in a partially open position.
Figure 4:
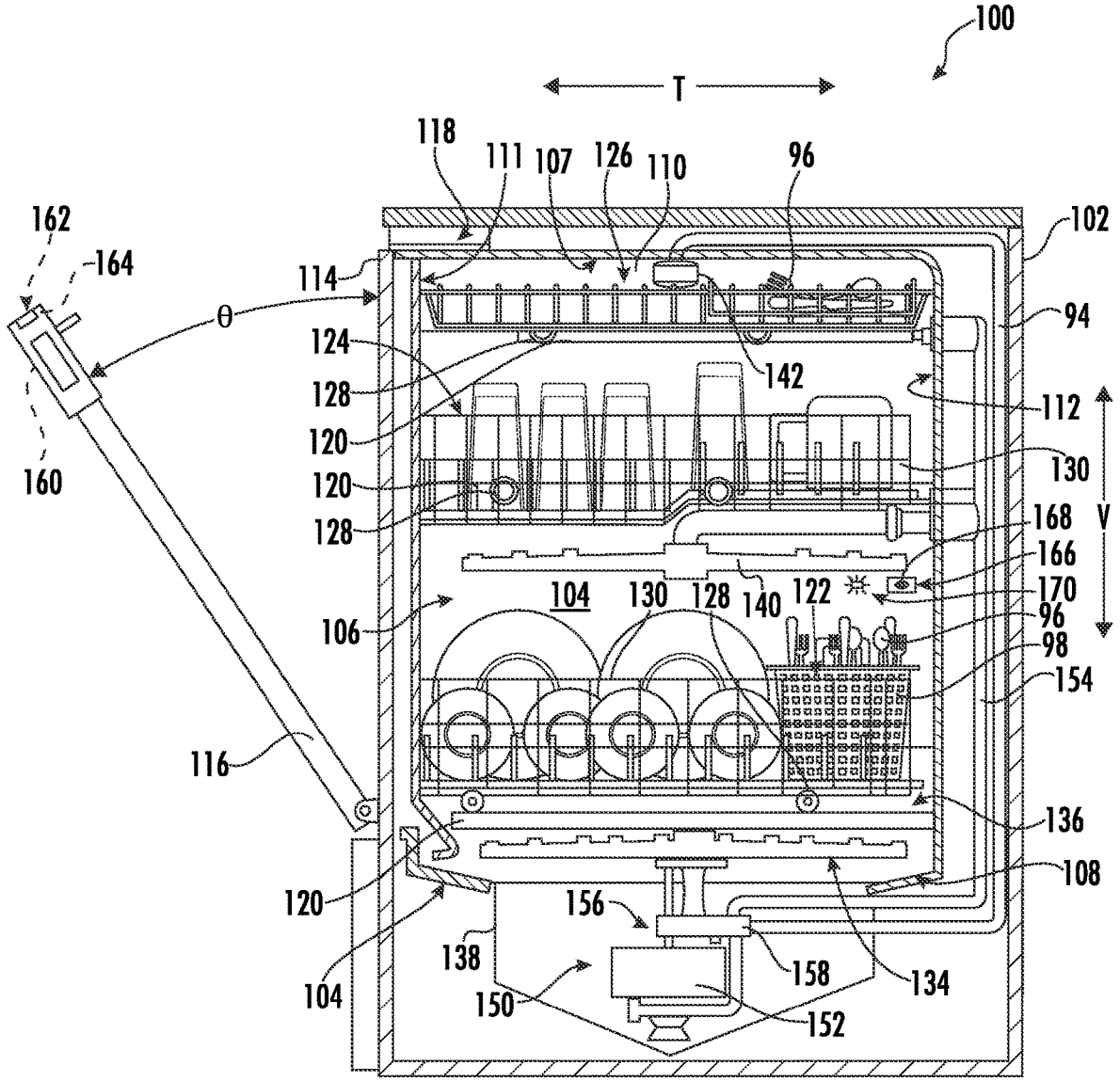
FIG. 4 provides another side, cross sectional view of the exemplary dishwashing appliance of FIG. 1 with the door in another partially open position.

The tub 104 includes a front opening 114 and a door 116 hinged at its bottom for movement between a normally closed vertical position (shown in FIG. 2), wherein the wash chamber 106 is sealed shut for washing operation, and a horizontal, fully open position for loading and unloading of articles from the dishwasher 100. Partially open positions of door 116 are shown in FIGS. 3 and 4. According to exemplary embodiments, dishwasher 100 further includes a door closure mechanism or assembly 118 that is used to lock and unlock door 116 for accessing and sealing wash chamber 106.

As best illustrated in FIGS. 2 and 3, tub side walls 110 accommodate a plurality of rack assemblies. More specifically, guide rails 120 may be mounted to side walls 110 for supporting a first rack assembly 122 (also referred to as a lower rack assembly 122), a middle rack assembly 124 (also referred to as a second rack assembly 124), and a third rack assembly 126 (also referred to as an upper rack assembly 126). As illustrated, third rack assembly 126 is positioned at a top portion of wash chamber 106 above middle rack assembly 124, which is positioned above lower rack assembly 122 along the vertical direction V. Each rack assembly 122, 124, 126 is adapted for movement between an extended loading position (not shown) in which the rack is substantially positioned outside the wash chamber 106, and a retracted position (shown in FIGS. 1 and 2) in which the rack is located inside the wash chamber 106. This is facilitated, for example, by rollers 128 mounted onto rack assemblies 122, 124, 126, respectively. Although a guide rails 120 and rollers 128 are illustrated herein as facilitating movement of the respective rack assemblies 122, 124, 126, it should be appreciated that any suitable sliding mechanism or member may be used according to alternative embodiments.

Some or all of the rack assemblies 122, 124, 126 are fabricated into lattice structures including a plurality of wires or elongated members 130 (for clarity of illustration, not all elongated members making up rack assemblies 122, 124, 126 are shown in FIG. 2). In this regard, rack assemblies 122, 124, 126 are generally configured for supporting articles within wash chamber 106 while allowing a flow of wash fluid to reach and impinge on those articles, e.g., during a cleaning or rinsing cycle. For this embodiment, a silverware basket 98 is removably attached to a rack assembly, e.g., lower rack assembly 122, for placement of silverware 96, utensils, and the like, that are otherwise too small or delicate to be accommodated by rack 122. As will be described later, for FIG. 3, silverware basket 98 is not present and silverware 96 has been placed instead into rack assembly 126.

Dishwasher 100 further includes a plurality of spray assemblies for urging a flow of water or wash fluid onto the articles placed within wash chamber 106. More specifically, as illustrated in FIGS. 2, 3, and 4, dishwasher 100 includes a first spray assembly 134 (also referred to as a lower spray arm assembly 134) disposed in a lower region 136 of wash chamber 106 and above a sump 138 so as to rotate in relatively close proximity to lower rack assembly 122. Similarly, a second spray assembly 140 (also referred to as a mid-level spray arm assembly 140) is located in an upper region of wash chamber 106 and may be located below and in close proximity to middle rack assembly 124. In this regard, mid-level spray arm assembly 140 may generally be configured for urging a flow of wash fluid up through middle rack assembly 124 and third rack assembly 126. Additionally, a third spray assembly 142 (also referred to as an upper spray assembly 142) may be located above third rack assembly 126 along the vertical direction V. In this manner, third spray assembly 142 may be configured for urging and/or cascading a flow of wash fluid downward over rack assemblies 122, 124, and 126.

The various spray assemblies and manifolds described herein may be part of a fluid distribution system or fluid circulation assembly 150 for circulating water and wash fluid in the tub 104. More specifically, fluid circulation assembly 150 includes a pump 152 for circulating water and wash fluid (e.g., detergent, water, and/or rinse aid) in the tub 104. Pump 152 may be located within sump 138 or within a machinery compartment located below sump 138 of tub 104, as generally recognized in the art. Fluid circulation assembly 150 may include one or more fluid conduits or circulation piping for directing water and/or wash fluid from pump 152 to the various spray assemblies and manifolds. For example, as illustrated in FIG. 2, a primary supply conduit 154 may extend from pump 152, along rear 112 of tub 104 along the vertical direction V to supply wash fluid throughout wash chamber 106. A secondary supply conduit 94

As illustrated, primary supply conduit 154 is used to supply wash fluid to mid-level spray arm assembly 140 while a secondary supply conduit 94 supplies wash fluid to upper spray assembly 142. Diverter assembly 156 can allow selection between spray assemblies 134, 140 and 142 being supplied with wash fluid. However, it should be appreciated that according to alternative embodiments, any other suitable plumbing configuration may be used to supply wash fluid throughout the various spray manifolds and assemblies described herein.

Each spray assembly 134, 140, 142 or other spray device may include an arrangement of discharge ports or orifices for directing wash fluid received from pump 152 onto dishes or other articles located in wash chamber 106. The arrangement of the discharge ports, also referred to as jets, apertures, or orifices, may provide a rotational force by virtue of wash fluid flowing through the discharge ports. Alternatively, spray assemblies 134, 140, 142 may be motor-driven, or may operate using any other suitable drive mechanism. Spray manifolds and assemblies may also be stationary.

Movement of the spray arm assemblies 134 and 140 and the spray from fixed manifolds like spray assembly 142 provides coverage of dishes, silverware, and other dishwasher contents and articles to be cleaned with a washing spray. Other configurations of spray assemblies may be used as well. For example, dishwasher 100 may have additional spray assemblies for cleaning silverware, for scouring casserole dishes, for spraying pots and pans, for cleaning bottles, etc. One skilled in the art will appreciate that the embodiments discussed herein are used for the purpose of explanation only, and are not limitations of the present subject matter.

In operation, pump 152 draws wash fluid in from sump 138 and pumps it to a diverter assembly 156, e.g., which is positioned within sump 138 of dishwasher appliance. Diverter assembly 156 may include a diverter disk (not shown) disposed within a diverter chamber 158 for selectively distributing the wash fluid to the spray assemblies 134, 140, 142 and/or other spray manifolds or devices. For example, the diverter disk may have a plurality of apertures that are configured to align with one or more outlet ports (not shown) at the top of diverter chamber 158. In this manner, the diverter disk may be selectively rotated to provide wash fluid to the desired spray device.

According to an exemplary embodiment, diverter assembly 156 is configured for selectively distributing the flow of wash fluid from pump 152 to various fluid supply conduits, only some of which (e.g., 94 and 154) are illustrated in FIG. 2 for clarity. More specifically, diverter assembly 156 may include four outlet ports (not shown) for supplying wash fluid to a first conduit for rotating lower spray arm assembly 134 in the clockwise direction, a second conduit for rotating lower spray arm assembly 134 in the counter-clockwise direction, a third conduit for spraying rack assembly 126 (shown in FIGS. 2 and 3) as a silverware rack, and a fourth conduit for supplying only mid-level and/or upper spray assemblies 140, 142. Other configurations of diverter assembly 156 and/or other components (e.g., valves) may be used to allow various choices in the operation of the spray assemblies 134, 140, and 142 during a cleaning cycle.

The dishwasher 100 is further equipped with a controller 160 to regulate operation of the dishwasher 100. Controller 160 may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 160 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

The controller 160 may be positioned in a variety of locations throughout dishwasher 100. In the illustrated embodiment, the controller 160 may be located within a control panel area 162 of door 116 as shown in FIGS. 1 and 2. In such an embodiment, input/output ("I/O") signals may be routed between the control system and various operational components of dishwasher 100 along wiring harnesses that may be routed through the bottom of door 116. Typically, the controller 160 includes a user interface panel/controls 164 through which a user may select various operational features and modes and monitor progress of the dishwasher 100. In one embodiment, the user interface 164 may represent a general purpose I/O ("GPIO") device or functional block. In one embodiment, the user interface 164 may include input components, such as one or more of a variety of electrical, mechanical or electro-mechanical input devices including rotary dials, push buttons, and touch pads. The user interface 164 may include a display component, such as a digital or analog display device designed to provide operational feedback to a user. The user interface 164 may be in communication with the controller 160 via one or more signal lines or shared communication busses.

Dishwasher 100 may also be configured to communicate wirelessly with a cloud-server that may include a database or may be, e.g., a cloud-based data storage system and may also include image recognition and processing capabilities including artificial intelligence as further described below. For example, appliance 100 may communicate with cloud-server over the Internet, and appliance 100 may access via WI-FI®, such as from a WI-FI® access point in a user's home or through a mobile device. Alternatively, dishwasher 100 may be equipped with such image recognition and processing capabilities as part of controller 160 and/or other components onboard appliance 100.

It should be appreciated that the invention is not limited to any particular style, model, or configuration of dishwasher 100. The exemplary embodiment depicted in FIGS. 1 and 2 is for illustrative purposes only. For example, different locations may be provided for user interface 164, different configurations may be provided for rack assemblies 122, 124, 126, different spray assemblies 134, 140, 142 and spray manifold configurations may be used, and other differences may be applied while remaining within the scope of the present subject matter.

Dishwasher 100 includes a camera assembly or other optical sensor assembly 166, which may be positioned along one of the sidewalls 110. For this exemplary embodiment, camera assembly 166 includes a sensor 168 (e.g., a camera) for obtaining images of the door 116 and particularly images that can be used to determine the position of door 116 relative to the tub 104. For example, the position of door 116 is different in each of FIGS. 2, 3, and 4. In FIG. 2, door 116 is shown closed while in FIGS. 3 and 4 door 116 is partially open—albeit at different positions as will be further described.

In other embodiments, camera assembly 166 may be positioned so that it has a view of another desired location in, or desired portion of, wash chamber 106. Thus, although shown on one of the sidewalls 110 near door 116, camera assembly 166 could be placed at other locations along sidewalls 110, rear wall 112, or even door 116 provided such placement allows for a view and resulting capture of an image from which the position of door 116 relative to wash tub 104 (e.g., front opening 114 thereof) may be determined.

Camera assembly 166 may include any suitable number, type, size, and configuration of camera(s) 168 for obtaining images in wash chamber 106. In general, camera(s) 168 may include a lens that is constructed from a clear hydrophobic material or which may otherwise be positioned behind a hydrophobic clear lens. So positioned, camera assembly 166 may obtain one or more images or videos of articles and/or rack assemblies within wash chamber 106, as described in more detail below. For the exemplary embodiment of FIGS. 2 and 3, camera assembly is positioned with a view of first rack assembly 122 where basket 98 would normally be located.

Referring still to FIGS. 2 through 4, dishwashing appliance 100 may further include one or more of a wash chamber light 170 positioned within cabinet 102 or wash chamber 106 for selectively illuminating wash chamber 106, the articles positioned therein, and/or door 116. Specifically, light 170 may be separate from camera assembly 166 or may be integrated into camera assembly 166. In one embodiment, light 170 is positioned immediately adjacent camera assembly 166. According to still other embodiments, light 170 may be positioned at any other suitable location within cabinet 102. It should be appreciated that according to alternative embodiments, dish washing appliance 100 may include any other camera or system of imaging devices for obtaining images to determine the position of door 116. In addition, these cameras may be positioned at any suitable location within cabinet 102, may include any suitable lighting features, and may utilize any suitable photography or imaging technology.

Notably, controller 160 of dishwashing appliance 100 (or any other suitable dedicated controller) may be communicatively or operably coupled to camera assembly 166, camera 168, tub light 186, and/or other components of appliance 100. As explained in more detail below, controller 160 may be programmed or configured for analyzing the images obtained by camera assembly 166, e.g., in order to determine the location or position of door 116 relative to cabinet 102 and may use this information to make informed decisions regarding the operation of dishwashing appliance 100. Alternatively, such images from camera assembly 166 may be transmitted or uploaded to e.g., a cloud-server or cloud-based system for further processing of such information as will also be further described. The images may also be electronically stored by dishwashing appliance 100 as part of the process by which appliance 100 utilizes the same to determine the location or position of door 116 relative to cabinet 102.

Figure 5:
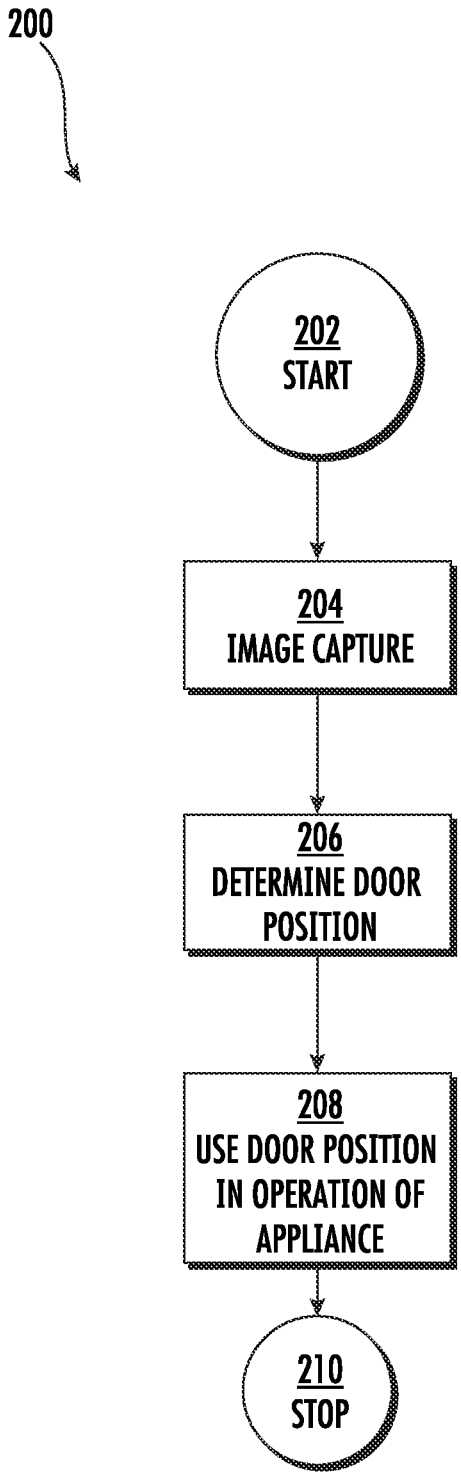
FIG. 5 provides an illustration of an exemplary process of the present invention.

Referring now to FIG. 5, an exemplary method 200 of operating a dishwashing appliance such as appliance 100 will be described. Although the discussion below refers to the exemplary method 200 of operating appliance 100, one skilled in the art will appreciate that the exemplary method 200 is applicable to the operation of a variety of other dishwashing appliances having different configurations and equipment and that the steps disclosed herein may be performed by e.g., controller 160 in whole, or in part, and in conjunction with one or more separate systems including cloud-based systems. Reference to a "step" or other action does not prevent such from being performed in a series of steps or multiple actions unless otherwise stated and does mean such step is necessarily required in all exemplary aspects of the present invention. The order of such steps or actions may also be altered unless otherwise stated.

In step 202, exemplary algorithm or method 200 is initiated. One or more of a variety of events might cause e.g., controller 160 to begin execution of the steps in method 200. For example, step 202 could be that dishwasher 100 is activated or started. For example, through interface 164, a user may actuate a cleaning cycle of appliance 100. Such may include the selection, using interface 164, of one or more options for the cleaning cycle followed by closing door 116. Activation may also come after a period of delay, which the user may select.

In still other examples, the "start" in step 202 could be the powering up of appliance 100 after which it proceeds to step 204. Step 202 could also occur after a predetermined time period in which appliance 100 detects that door 116 is not closed. More specifically, appliance 100 may have features that determine whether 116 is latched or secured by assembly 118 and provide such information to controller 160. A signal indicating that door 116 has been unlatched or opened could be used by controller 160 to start or execute method 200 in order to determine the position of door 116. In another exemplary aspect, method 200 could be started on periodic intervals after door 116 is open. More specifically, if appliance 100 detects that door 116 is not closed, method could be executed over and over at periodic intervals to determine the position of door 116 and perhaps whether such position has changed since the last determination. As used herein with reference to door 116, "closed" means door 116 is in a position to cover the front opening 114 of wash tub 104 to prevent fluids from escaping and allow a cleaning cycle to begin. As used herein with reference to door 116, "open" means door 116 is not in the closed position. Door 116 can be in various open positions (e.g., compare FIGS. 3 and 4) with "fully open" meaning door 116 is substantially horizontal.

Next, in step 204, dishwasher 100 obtains or captures one or more images (which may be e.g., still shots, videos, or both) of door 116 and wash tub 104. Such image(s) need not include a view of all of door 116 or tub 104. Only portions of such may be include in such image provided it is sufficient for determining the position of door 116 relative to tub 104. Door 116, tub 104, or both may also be provided with a decal or other indicia to aid in the image recognition and position determination. As used herein, "image" includes a single photograph or representation (e.g., a digital or electronic file) of the view of camera assembly 166, multiple such photographs or representations, and/or videos from which image processing can be performed to determine the position of door 116 relative to tub 104.

After one or more images are obtained, in step 206 a determination is made as to the position of door 116 relative to tub 104. Returning to FIGS. 2, 3, and 4, for example, door 116 is shown in different possible positions While the "position" may be expressed in different ways and measurement units, in one exemplary aspect of the invention, each such position could be represented by, or expressed in the form of, an angle θ. Such may also be referred to as the "angular position" of door 116. As shown in these figures, angle θ is the degree to which door 116 is open and represents the angle between door 116 and front opening 114 as formed by tub 104. For example, angle θ is zero in FIG. 2, about 15 degrees in FIG. 3, and about 45 degrees in FIG. 4. An angle θ of 90 degrees would represent a fully open position of door 116. Angle θ could also be expressed in radians. Other means of representing the position of door 116 could be used as well. Using the teachings disclosed herein, it will also be understood that the position of door 116 could be specified based on e.g., the distance between e.g., a certain location on door 116 and a certain location on rear wall 112. Regardless of the particular measurement or methodology used, one or more images provided by camera assembly 166 are used to determine the position of door 116 relative to tub 104.

As used herein, the terms "image recognition process" and similar terms may be used generally to refer to any suitable method of observation, analysis, image decomposition, feature extraction, image classification, etc. of one or more image or videos taken of appliance 100 and particularly door 116. In this regard, the image recognition process may use any suitable artificial intelligence (AI) technique, for example, any suitable machine learning technique, or for example, any suitable deep learning technique. It should be appreciated that any suitable image recognition software or process may be used to analyze images taken by camera assembly 166.

Controller 160, or components of appliance 100, or combinations thereof may be programmed and otherwise configured to perform such processes. In another exemplary aspect of the invention, one or more images (e.g., data regarding such one or more images) from camera assembly 166 may be uploaded by appliance 100 (using e.g., the Internet) to a cloud-based server or cloud server that uses an image recognition process including machine learning to determine the position of door 116. In which event, exemplary method 200 can include control 160 receiving data back from the cloud-based server including data indicating the position of door 116 relative to tub 104.

According to an exemplary embodiment, the image recognition so performed on the cloud and/or by controller 160 may implement a form of image recognition called region based convolutional neural network ("R-CNN") image recognition. Generally speaking, R-CNN may include taking an input image and extracting region proposals that include a potential object such as door 116, tub 104, portions thereof, indicia provided on door 116 and/or tub 104, or the like. In this regard, a "region proposal" may be regions in an image that could belong to a particular object, such as a particular part of the door, tub, or other article (e.g., a portion of the door or tub). A convolutional neural network is then used to compute features from the regions proposals and the extracted features will then be used to determine a classification for each particular region.

According to still other embodiments, an image segmentation process may be used along with the R-CNN image recognition. In general, image segmentation creates a pixel-based mask for each object in an image and provides a more detailed or granular understanding of the various objects within a given image. In this regard, instead of processing an entire image—i.e., a large collection of pixels, many of which might not contain useful information—image segmentation may involve dividing an image into segments (e.g., into groups of pixels containing similar attributes) that may be analyzed independently or in parallel to obtain a more detailed representation of the object or objects in an image. This may be referred to herein as "mask R-CNN" and the like.

According to still other embodiments, the image recognition process may use any other suitable neural network process. Step 206 may include e.g., using Mask R-CNN instead of a regular R-CNN architecture. In this regard, Mask R-CNN is based on Fast R-CNN which is slightly different than R-CNN. For example, R-CNN first applies CNN and then allocates it to zone recommendations on a covn5 property map instead of the initially split into zone recommendations. In addition, according to exemplary embodiments, standard CNN may be used to obtain a quantification of the water level. In addition, a K-means algorithm may be used. Other image recognition processes are possible and within the scope of the present subject matter.

It should be appreciated that any other suitable image recognition process may be used while remaining within the scope of the present subject matter. For example, step 206 may include using a deep belief network ("DBN") image recognition process. A DBN image recognition process may generally include stacking many individual unsupervised networks that use each network's hidden layer as the input for the next layer. According to still other embodiments, step 204 may include the implementation of a deep neural network ("DNN") image recognition process, which generally includes the use of a neural network (computing systems inspired by the biological neural networks) with multiple layers between input and output. Other suitable image recognition processes, neural network processes, artificial intelligence ("AI") analysis techniques, and combinations of the above described or other known methods may be used while remaining within the scope of the present subject matter.

According to exemplary embodiments of the present subject matter, the image analysis performed at step 206 may generally monitor any suitable qualitative or quantitative aspect of e.g., door 116, tub 104, or wash chamber 106 which might be indicative of the position of door 116. For example, the analysis may include the monitoring of at least one of a color tone, a size, reflectiveness, or other features of door 116 or other elements.

With continuing reference to FIG. 5, in step 208, the position of door 116 relative to tub 104 is used in one or more operations of appliance 100. Any operation which might be initiated or modified based on the relative position of door 116 is within the scope of the present invention. Non-limiting examples of such will be further described.

In one exemplary aspect, a notification may be provided to the user based on the position of door 116. As previously mentioned, door 116 may appear closed to a user of appliance 100. A user may have selected a desired cycle for appliance 100 and pushed door 116 towards cabinet 102 with the intention of placing door 116 in the closed position of FIG. 2. However, unbeknownst to the user, door 116 may still be slightly open such that latch assembly 118 has not secured door 116 and a cleaning cycle cannot begin. In such circumstances, controller 160 may provide a notification to the user such as a visual and/or audible alarm. Such may only be provided after a certain time interval as well e.g., to allow the user time to correct the door position before notification is given.

In still another example, appliance 100 may prevent the execution of a cleaning cycle if it is determined that door 116 is not closed or may stop a cycle if it is determined that door 116 has been opened. Such features based on the use of one or more images from camera assembly 166 might be useful as e.g., a backup to detection of closed door through latch assembly 118.

Although FIG. 5 depicts method 200 as stopping in step 210, in another exemplary aspect, the method could also loop back to step 202 or 204. For example, the method might include a continuous or semi-continuous monitoring of the door position for purposes of dishwashing operations.

Using the teaching disclosed herein, one of skill in the art will understand that determining the position of door 116 can be used in still other dishwashing operations for appliance 100 including activation or modification of various cleaning cycles or other types of cycles as well. As such, this written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A dishwasher appliance, comprising:

a tub defining a wash chamber for receipt of articles for washing, the tub having a front opening;

a door positioned adjacent to the tub at the front opening and configured for selectively pivoting between closed and open positions;

one or more rack assemblies positioned within the wash chamber;

a camera assembly mounted within the wash chamber with a view of the door and the front opening to the tub; and a controller operably coupled with the camera assembly, the controller configured for:

obtaining an image of the door and tub;

determining the position of the door relative to the tub using an analysis of the image based on at least one of a color tone, size, or reflectiveness of the door; and using the position of the door in one or more dishwashing operations.

2. The dishwasher appliance of claim 1, wherein the determining further comprises uploading data regarding the image to a cloud-based server.

3. The dishwasher appliance of claim 2, wherein the determining further comprises receiving data from the cloud-based server that indicates the position of the door relative to the tub.

4. The dishwasher appliance of claim 3, wherein the determining further comprises using a machine learning image recognition process for analyzing the image.

5. The dishwasher appliance of claim 4, wherein the determining further comprises determining an angle between the door and the tub.

6. The dishwasher appliance of claim 4, wherein the using comprises providing a notification to a user of the dishwasher appliance if the position of the door is not in a closed position.

7. The dishwasher appliance of claim 1, wherein the determining further comprises using a machine learning image recognition process for analyzing the image.

8. The dishwasher appliance of claim 1, wherein the determining further comprises determining an angle between the door and the wash chamber.

9. The dishwasher appliance of claim 1, wherein the using comprises providing a notification to a user of the dishwasher appliance if the position of the door is not in a closed position.

10. A method of operating a dishwasher appliance having a door and tub defining a wash chamber, the method comprising:

obtaining an image of the door and tub;

determining the position of the door relative to the tub using an analysis of the image based on at least one of a color tone, size, or reflectiveness of the door; and using the position of the door in one or more dishwashing operations.

11. The method of operating a dishwasher appliance as in claim 10, wherein the determining further comprises uploading data regarding the image to a cloud-based server.

12. The method of operating a dishwasher appliance as in claim 11, wherein the determining further comprises receiving data from the cloud-based server that indicates the position of the door relative to the tub.

13. The method of operating a dishwasher appliance as in claim 12, wherein the determining further comprises using a machine learning image recognition process for analyzing the image.

14. The method of operating a dishwasher appliance as in claim 13, wherein the determining further comprises determining an angle between the door and the tub.

15. The method of operating a dishwasher appliance as in claim 14, wherein the using comprises providing a notification to a user of the dishwasher appliance if the position of the door is not in a closed position.

16. The method of operating a dishwasher appliance as in claim 10, wherein the determining further comprises using a machine learning image recognition process for analyzing the image.

17. The method of operating a dishwasher appliance as in claim 10, wherein the determining further comprises determining an angle between the door and the tub.

18. The method of operating a dishwasher appliance as in claim 10, wherein the using comprises providing a notification to a user of the dishwasher appliance if the position of the door is not in a closed position.

* * * * *